US005681103A

United States Patent [19]

Remillard et al.

[11] Patent Number: 5,681,103

[45] Date of Patent: Oct. 28, 1997

[54] ELECTROSTATIC SHUTTER PARTICULARLY FOR AN AUTOMOTIVE HEADLAMP

[75] Inventors: Jeffrey T. Remillard, Ypsilanti, Mich.; Timothy Fohl, Carlisle, Mass.; Alfred Wasilewski, Northville, Mich.

[73] Assignee: Ford Global Technologies, Inc., Dearborn, Mich.

[21] Appl. No.: 566,520

[22] Filed: Dec. 4, 1995

[51] Int. Cl.[6] ..... F21V 7/04

[52] U.S. Cl. ..... 362/32; 362/278; 362/320; 359/227; 359/231

[58] Field of Search ..... 362/32, 278, 320, 362/321; 359/231, 227

[56] References Cited

U.S. PATENT DOCUMENTS

| | | | |
|---|---|---|---|
| 3,553,364 | 1/1971 | Lee | 178/7.3 |
| 3,746,911 | 7/1973 | Nathanson et al. | 315/21 |
| 3,772,537 | 11/1973 | Clifford et al. | 310/6 |
| 3,897,997 | 8/1975 | Kalt | 350/161 |
| 3,989,357 | 11/1976 | Kalt | 350/161 |
| 4,094,590 | 6/1978 | Kalt | 350/269 |
| 4,105,294 | 8/1978 | Peek | 350/269 |
| 4,208,103 | 6/1980 | Kalt et al. | 350/269 |
| 4,229,075 | 10/1980 | Ueda et al. | 350/269 |
| 4,234,245 | 11/1980 | Toda et al. | 350/269 |
| 4,235,522 | 11/1980 | Simpson et al. | 350/266 |
| 4,248,501 | 2/1981 | Simpson | 350/266 |
| 4,323,952 | 4/1982 | Proske | 362/17 |
| 4,336,536 | 6/1982 | Kalt et al. | 340/783 |
| 4,403,248 | 9/1983 | Te Velde | 358/62 |
| 4,420,896 | 12/1983 | Castleberry | 40/427 |
| 4,468,663 | 8/1984 | Kalt | 340/815.27 |
| 4,488,784 | 12/1984 | Kalt et al. | 350/359 |
| 4,529,620 | 7/1985 | Glenn | 427/88 |
| 4,695,837 | 9/1987 | Kalt | 340/763 |
| 4,704,667 | 11/1987 | Ploeger | 362/318 |
| 4,729,636 | 3/1988 | Te Velde et al. | 350/269 |
| 4,741,599 | 5/1988 | Togo et al. | 350/269 |
| 4,747,670 | 5/1988 | Devio et al. | 350/269 |
| 4,794,370 | 12/1988 | Simpson et al. | 340/825 |
| 4,805,038 | 2/1989 | Seligson | 358/296 |
| 4,807,967 | 2/1989 | Veenvliet et al. | 350/269 |
| 4,878,122 | 10/1989 | Glenn | 358/233 |
| 4,879,602 | 11/1989 | Glenn | 358/233 |
| 4,891,635 | 1/1990 | Hata | 340/783 |
| 4,948,708 | 8/1990 | Veenvliet et al. | 430/316 |
| 4,949,227 | 8/1990 | Finch et al. | 362/61 |
| 4,956,619 | 9/1990 | Hornbeck | 330/4.3 |
| 4,974,253 | 11/1990 | Nadir | 340/324 |
| 4,985,816 | 1/1991 | Seko et al. | 362/303 |
| 5,023,758 | 6/1991 | Allen et al. | 362/61 |
| 5,161,875 | 11/1992 | Sikiguchi et al. | 362/61 |
| 5,231,559 | 7/1993 | Kalt et al. | 361/301 |
| 5,233,459 | 8/1993 | Bozler et al. | 359/230 |
| 5,255,163 | 10/1993 | Neumann | 362/61 |
| 5,264,993 | 11/1993 | Neumann et al. | 362/61 |
| 5,347,433 | 9/1994 | Sedlmayr | 362/32 |
| 5,353,133 | 10/1994 | Bernkopf | 359/41 |

*Primary Examiner*—Carroll B. Dority
*Attorney, Agent, or Firm*—Daniel M. Stock

[57] ABSTRACT

An electrostatic shutter includes an input window, an electrical contact connected to the voltage source, a metallized polymer scroll having one end electrically connected to the electrical contact, an electrically and thermally conductive heat sink selectably connected to the voltage source and so that a potential difference exists between the electrical contact and the heat sink and an electrical insulator covering the heat sink. When a sufficient voltage potential exists between the scroll and the heat sink, the scroll unrolls so that the scroll is in direct contact with the input window and thermally coupled to the heat sink through the insulator and the input window.

17 Claims, 3 Drawing Sheets

ELECTROSTATIC SHUTTER PARTICULARLY FOR AN AUTOMOTIVE HEADLAMP

RELATED APPLICATIONS

This application is related to commonly assigned patent application Ser. No. 08/566,468 filed concurrently herewith.

FIELD OF THE INVENTION

The present invention relates generally to a light control device and, more specifically, to an improved electroscopic shutter particularly suited for automotive forward lighting applications.

BACKGROUND OF THE INVENTION

Electrostatic devices are described in numerous patent application. Early examples of such devices are described in U.S. Pat. Nos. 3,772,537 and 3,989,357. In these patents and many others used for display devices a transparent substrate has a transparent electrode covering the surface of the substrate. A transparent insulator covers the transparent electrode. A rolled electrode made of a layer of plastic and a layer of conductive material such as aluminum unrolls when a potential difference exists between the electrode and the conductive material.

One disadvantage of the prior art is that those devices are particularly suited for relatively low heat applications. Using such a device for example in a relatively high heat application such a forward lighting typically exceeds the limits of the prior art. Heat build up in the rolled electrode causing damage to the electrode. Another problem is that some light is lost to reflection losses caused by the transparent conductor and insulator. Another problem associated with the prior art is that transparent conductor and insulators are more expensive than opaque conductors and insulators.

It would therefore be desirable to provide an electrostatic shutter able to withstand the high heat applications such as forward lighting in an automotive vehicle.

SUMMARY OF THE INVENTION

The present invention overcomes the disadvantages of the related art by providing an input window, an electrical contact connected to the voltage source, a metallized polymer scroll having one end electrically connected to the electrical contact, an electrically and thermally conductive heat sink selectably connected to the voltage source and so that a potential difference exists between the electrical contact and the heat sink and an electrical insulator covering the heat sink. When a sufficient voltage potential exists between the scroll and the heat sink, the scroll unrolls so that the scroll is in direct contact with the input window and thermally coupled to the heat sink through the insulator and input window.

One advantage of the electrostatic shutter of the present invention is that the insulator and the conductor do not need to extend over the input window. This results in the following benefits:

the reflection loses and glare due to the extra layers are eliminated;

opaque materials can be used for the insulating layer and the conductive layer that may result in significant cost savings and improved device performance; and the heating of these layers due to any optical absorption is also eliminated.

BRIEF DESCRIPTION OF THE DRAWINGS

These and other objects, advantages, and features of the present invention will be apparent to those skilled in the lighting arts upon reading the following description with reference to the accompanying drawings, in which.

DETAILED DESCRIPTION OF THE PREFERRED EMBODIMENT

Figure 1:
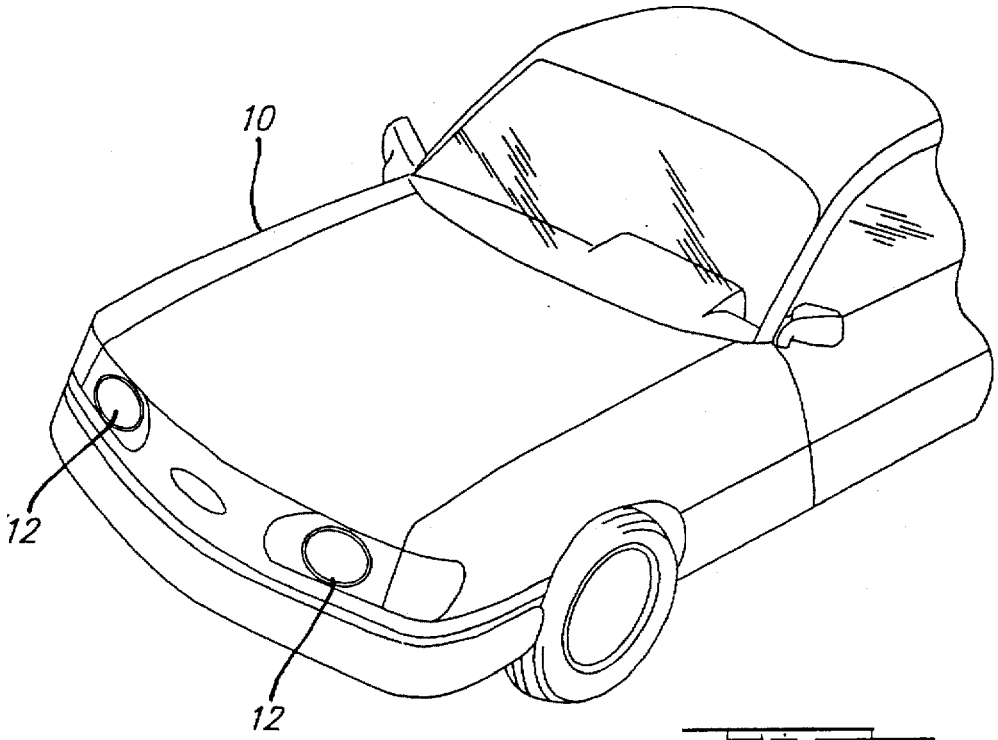
FIG. 1 is an automotive vehicle having a lighting system according to the present invention.

Referring to FIG. 1, an automobile 10 has a front lighting system comprised of lamps 12. Each of lamps 12 preferably provides both high beam and low beam operation.

Figure 2A:
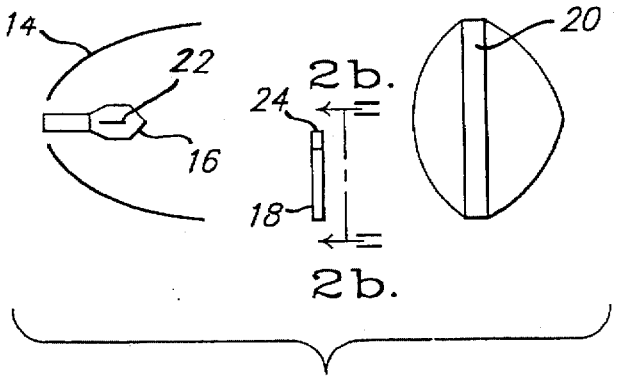
FIG. 2A is a cross-sectional view of a projector beam headlamp.

Referring now to FIG. 2A, a cross-sectional view of a projector headlamp is shown having a reflector 14, a light source 16, an aperture plate 18 and a lens 20. Reflector 14 has a generally ellipsoidal shape. The ellipsoid of reflector 14 has two focal points. The first focal point is located at a filament 22 of light source 16. The second focal point is located near top surface 24 of aperture plate 18.

Light source 16 may have a single filament 22. Light source 16 may also have a dual filament. One filament provides higher illumination for high beams.

Lens 20 is preferably an aspherical lens. Lens 20 has a focal length corresponding to the distance between the aspherical lens 20 and aperture plate 18.

Figure 2B:
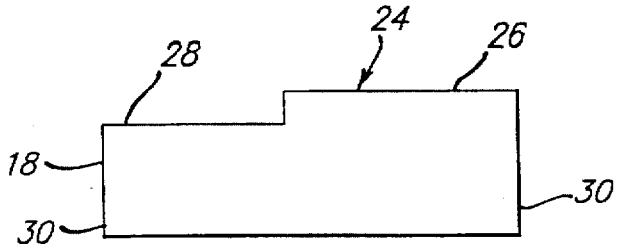
FIG. 2B is a front view of an aperture plate of FIG. 2A..

Referring now to FIG. 2B, the front view of aperture plate 18 is shown having a discontinuous top surface 24. Top surface 24 has a raised portion 26 and a lower portion 28. These portions are designed so that the light output of the headlamp will meet the required governmental regulations. Aperture plate 18 has laterally disposed edges 30. Aperture plate 18 is preferably formed of glass.

Figure 3:
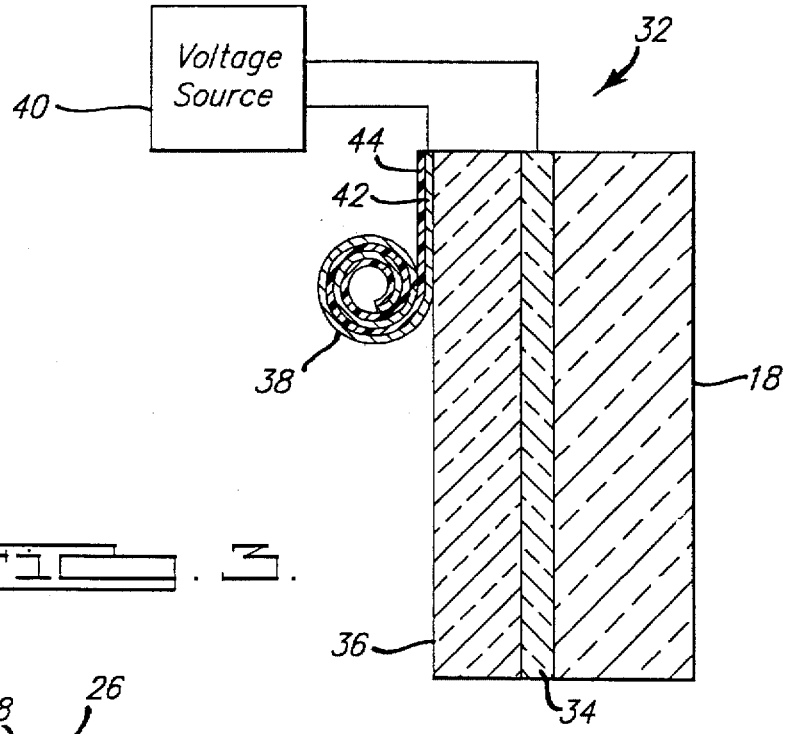
FIG. 3 is a cross-sectional view of the structure of an electrostatic shutter.

Referring now to FIG. 3, to maintain both high beam and low beam lamps in a single configuration, it is preferable to use an electrostatic shutter attached to aperture plate 18. In low beam operation aperture plate 18 has an electrostatic shutter 32 that blocks light from light source 16. In the high beam configuration, electrostatic shutter 32 is opened permitting substantially all the light from light source 16 to go through aperture plate 18 for maximum illumination.

Electrostatic shutter 32 is formed on aperture plate 18. One way in which electrostatic shutter 32 may be formed is by depositing a conductive coating 34 on the outer surface of aperture 18. Conductive coating 34 is transparent and may be made of any known transparent material such as indium tin oxide or any other suitable material. Conductive coating 34 is then insulated by a dielectric layer 36. Dielectric layer 36 is also formed of a transparent material such as plastic.

Over dielectric layer 36 a coiled scroll 38 is used to control the light entering aperture plate 18. Scroll 38 comprises a plastic layer 44 (a polymer like Mylar or Teflon) covered with an extremely thin layer of conductive material (e.g., an aluminum layer 42). Typically, aluminum layer 42 lies toward dielectric layer 36. Scroll 38 is unfurled when a potential difference exists between conductive coating 34 and aluminum layer 42. When an insufficient voltage potential is applied to aluminum layer 42, scroll 38 is rolled up.

Figure 4:
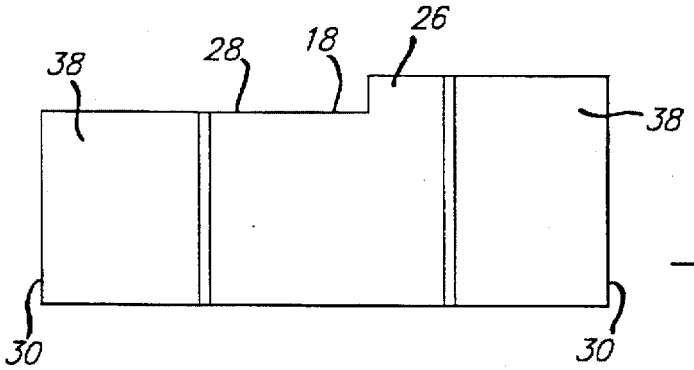
FIG. 4 is the front view of an aperture plate having two electrostatic shutters according to the present invention.

Referring now to FIG. 4, aperture plate 18 is shown using two scrolls 38 extending from laterally disposed edges 30 toward the middle of aperture plate 18. This embodiment uses two scrolls, the first scroll when unrolled covers the raised portion 26 of aperture plate 18 and the second scroll is unrolled on lower portion 28 of aperture plate 18. The length of each scroll is such that when a sufficient voltage is applied to the scrolls aperture plate 18 is completely blocked. When high beam is required, no voltage would be applied to either scroll so aperture plate is not blocked.

Figure 5:
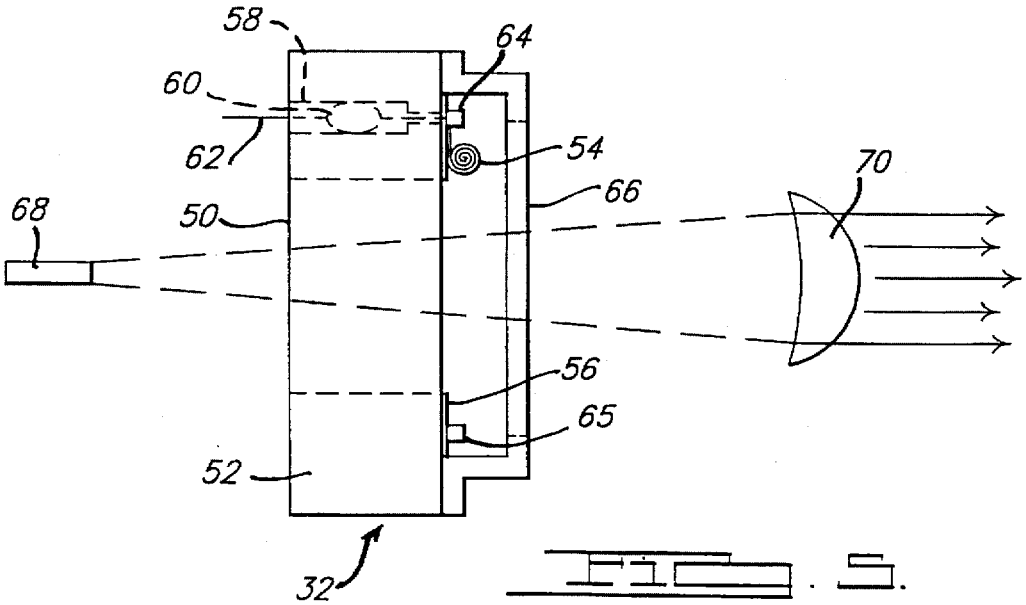
FIG. 5 is a cross-sectional of an alternative electrostatic shutter.

Referring now to FIG. 5, an alternative construction of electrostatic shutter 32 is shown. Shutter 32 has an input window 50, an electrically and thermally conductive heat sink 52 and a scroll 54.

Input window 50 is made of a transparent material capable of conducting heat such as glass.

Scroll 54 is preferably formed of the same aluminum and plastic layer material as described above.

Heat sink 52 preferably also acts as a ground plane. A suitable material for heat sink is aluminum. An insulator 56 separates scroll 54 from conductive heat sink 52. Heat sink 52 is located on an edge of input window 50. Heat sink 52 preferably surrounds input window 50.

A power feed is provided to scroll 54 preferably by a channel 58 in heat sink 52 that is electrically insulated from heat sink 52 by insulator 60. A wire 62 connects to a contact 64 that is insulated from heat sink 52 by an insulator 56. Contact 64 connects wire 62 to the aluminum layer of scroll 54.

This configuration may also have a cover 66 to protect the scroll 54 from damage. Cover 66 is preferably transparent and encloses scroll 54.

This configuration may be used for forward lighting system in an automotive vehicle where scroll 54 controls the transmission of light. A light pipe 68 may be used to provide light through electrostatic shutter 32. A lens 70 may also be used to form the light into the desired pattern. In this configuration it is also not necessary that the electrostatic shutter be used in a projector beam head lamp. However, as described below it certainly may. In addition, a stop bar 65 may be provided to provide an end point for the unrolling of scroll 54. Stop bar 65 is preferably electrically insulated from the heat sink 52 or is formed of non-conductive material.

Figure 6:
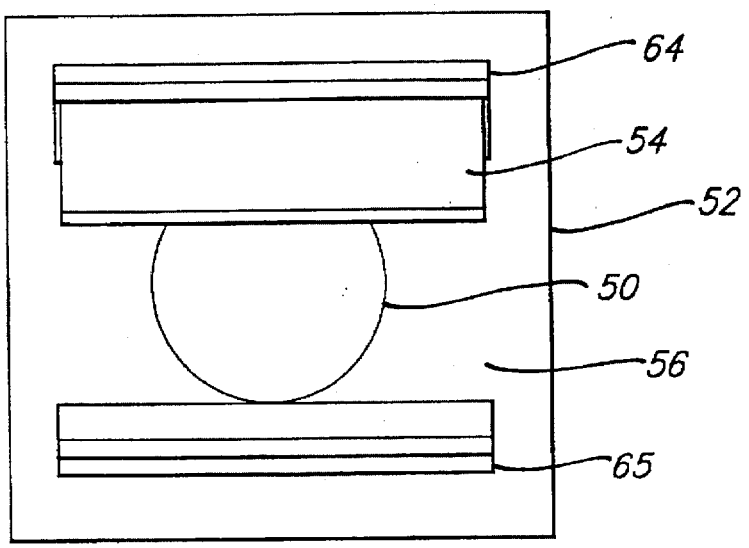
FIG. 6 is the front view of an alternative electrostatic shutter.

Referring now to FIG. 6, the front view of electrostatic shutter 32 of FIG. 5 is shown. Input window 50 may have a variety of shapes, including circular as shown.

One advantage of the electrostatic shutter of FIGS. 5 and 6 versus the electrostatic shutter shown in FIGS. 3 and 4 is that an insulator and a transparent conductor do not need to extend over input window 50. This results in the following benefits:

the reflection loses and glare due to the extra layers are eliminated;

opaque materials can be used for the insulating layer and the conductive layer that may result in significant cost savings and improved device performance; and the heating of these layers due to any optical absorption is also eliminated.

It is preferred that insulator 56 be of a type of material that is electrically insulative and thermally conductive when scroll 54 is unfurled. Scroll 54 is in intimate contact with heat sink 52 through insulator 56. Also, scroll is in direct contact with the input window 50. When scroll 54 is unfurled, it is in thermal contact with heat sink 52 through insulator 56 and directly through input window 50 that is in thermal contact with heat sink 52. To increase thermal coupling a coupling paste may be used between input window 50 and heat sink 52. Heat created by the absorption of light is drawn away from scroll 54 through heat sink 52. The reliability of this system is high in high temperature applications.

Figure 7:
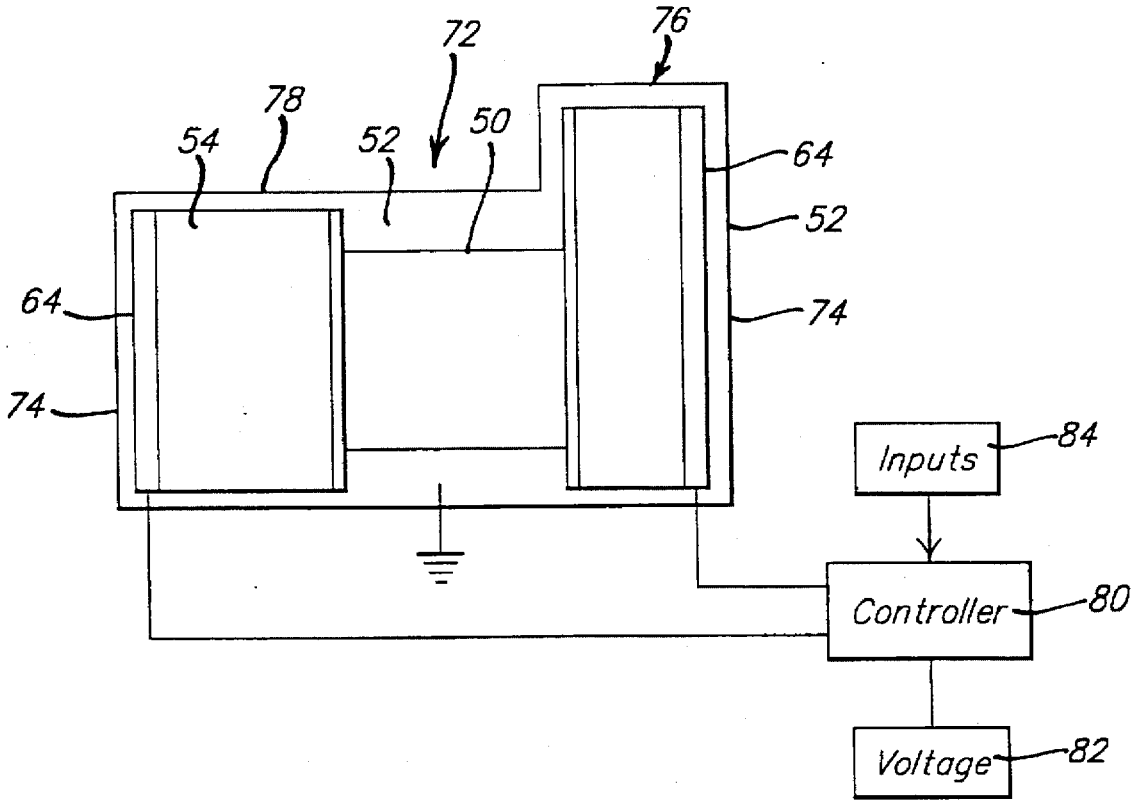
FIG. 7 is an alternative aperture plate constructed using an alternative electrostatic shutter.

Referring now to FIG. 7, an aperture plate 72 similar to aperture plate 18 of FIG. 4 is shown. Electrical contact 64 preferably positioned along laterally disposed edges 74 of aperture plate 72. Preferably, two scrolls are provided, one for raised portion 76 and one for lower portion 78.

A controller 80 controls the connection of voltage source 82 to the electrical contact 64. Inputs 84 provide necessary information for controller 80 to determine whether to roll or unroll scroll 54.

In one configuration input 84 may be a conventional driver operated switch to determine whether high beam or low beam lamps should be illuminated. If high beam lamps are required, no voltage is provided to contact 64 of aperture plate. If low beams are required controller 80 connects voltage source 82 to electrical contact 64 to unroll scroll 54 to block the light coming through input window 50.

In another embodiment sensing elements such as a motion detector, a turn signal indicator, or near-by vehicle sensing can be used as input to controller 80 to be used in the determination as to whether to unroll either scroll 54 depending on which way the vehicle is turning. If, for example, the vehicle is turning to the right the right scroll will unroll either partially or fully to illuminate the right side of the road. If the vehicle is turning left, the left scroll is unrolled to illuminate the left side of the road.

In another embodiment of the invention, the aperture opening may be variably controlled by controller 80 to provide high beam, low beam and an infinite combination therebetween. Inputs for such a function may be a driver control dial or based on inputs such as a light detector for detecting light of an oncoming vehicle and a speed detector based on the speed of the vehicle. If the vehicle is traveling at a high rate of speed and no oncoming traffic or traffic is in front of the vehicle high beams should not be used if an oncoming vehicle is present. If the vehicle is sufficiently far away such as across the median of a highway perhaps an opening between open and closed may be used between scrolls. One such means for detecting vehicles is a radar based system to detect the distance between the vehicles. As would be evident to one skilled in the art, several modifications of the invention may be made while still being within the scope of the appended claims. For example, the type of material used or the inputs and control strategy of the controller may be changed.

We claim:

1. An electrostatic shutter having a voltage source comprising;

an input window;

an electrical contact connected to said voltage source;

a metallized polymer scroll having one end electrically connected to said electrical contact;

an electrically and thermally conductive heat sink selectably connected to said voltage source and so that a potential difference exists between said electrical contact and said heat sink; and an opaque electrical insulator covering said heat sink;

so that when a sufficient voltage potential exists between said scroll and said heat sink said scroll unrolls so that said scroll is in direct contact with said input window and thermally coupled to said heat sink.

2. An electrostatic shutter as recited in claim 1 further comprising a light source adjacent said input window.

3. An electrostatic shutter as recited in claim 2 wherein said light source comprises a fiber optic light source.

4. An electrostatic shutter as recited in claim 1 further comprising a lens adjacent said input window for redirecting light from said light source.

5. An electrostatic shutter as recited in claim 1 further comprising a cover enclosing said scroll between said cover and said input window.

6. An electrostatic shutter as recited in claim 1 further comprising a scroll stop adjacent said heat sink.

7. An electrostatic shutter having a voltage source comprising:

an input window having at least one exterior edge;

an electrically and thermally conductive heat sink selectably connected to said voltage source adjacent at least one exterior edge;

an electrical contact connected to said voltage source;

a metallized polymer scroll having one end electrically connected to said electrical contact; and an opaque electrical insulator covering said heat sink;

so that when a sufficient voltage potential exists between said scroll and said heat sink said scroll unrolls so that said scroll is in direct contact with said input window and thermally coupled to said heat sink.

8. An electrostatic shutter as recited in claim 7 further comprising a light source adjacent said input window.

9. An electrostatic shutter as recited in claim 7 wherein said light source comprises a fiber optic light source.

10. An electrostatic shutter as recited in claim 7 further comprising a lens adjacent said input window for redirecting light from said light source.

11. An electrostatic shutter as recited in claim 7 further comprising a cover enclosing said scroll between said cover and said input window.

12. An electrostatic shutter as recited in claim 7 further comprising a scroll stop adjacent said heat sink.

13. An electrostatic shutter having a voltage source comprising;

an input window having two laterally disposed edges;

an electrically and thermally conductive heat sink selectably connected to said voltage source adjacent at least said laterally disposed edges;

a pair of electrical contacts connected to said voltage source;

a pair of metallized polymer scrolls each having one end electrically connected to one of said electrical contacts; and an opaque electrical insulator covering said heat sink;

so that when a sufficient voltage potential exists between said scrolls and said heat sink said scrolls unroll so that said scroll is in direct contact with said input window and thermally coupled to said heat sink through said insulator.

14. An electrostatic shutter as recited in claim 13 further comprising a light source adjacent said input window.

15. An electrostatic shutter as recited in claim 13 further comprising a lens adjacent said input window for redirecting light from said light source.

16. An electrostatic shutter as recited in claim 13 further comprising a cover enclosing said scroll between said cover and said input window.

17. An electrostatic shutter as recited in claim 13 further comprising a scroll stop adjacent said heat sink.

* * * * *